US006332727B1

(12) United States Patent
Hsu

(10) Patent No.: US 6,332,727 B1
(45) Date of Patent: Dec. 25, 2001

(54) BALLPOINT PEN STAND DECORATED WITH TWIST DANCING ORNAMENT

(76) Inventor: Ming-Tay Hsu, P.O. Box 82-144, Taipei (TW)

( * ) Notice: Subject to any disclaimer, the term of this patent is extended or adjusted under 35 U.S.C. 154(b) by 4 days.

(21) Appl. No.: 09/657,601

(22) Filed: Sep. 8, 2000

(51) Int. Cl.[7] ..... B43K 29/00

(52) U.S. Cl. ..... 401/195; 4/52; 442/146; 442/352

(58) Field of Search ..... 401/195, 52; 446/146, 446/330, 350, 352, 353

(56) References Cited

U.S. PATENT DOCUMENTS 3,390,460 * 7/1968 Brown et al. ..... 401/195
5,186,562 * 2/1993 Yoshinaga et al. ..... 401/112
5,208,987 * 5/1993 Christen ..... 33/18.1
5,433,642 * 7/1995 Chia ..... 446/71
6,146,721 * 11/2000 Freynet ..... 428/7

* cited by examiner

*Primary Examiner*—Gregory L. Huson
*Assistant Examiner*—Huyen Le
(74) *Attorney, Agent, or Firm*—A & J

(57) ABSTRACT

A ballpoint pen stand decorated with twist dancing ornament comprises an ornament, an ornament seat, a metal wire, a wire fastener, a pen barrel, an ink cartridge and a pen cap. When in complete assembly, the writer holds the ornament seat firmly with one hand, and turns the pen barrel lightly with other hand, as a result causing the wire fastener and the metal wire to rotate. At this moment, even though the ornament itself is motionless, however, the bent metal wire embedded in the ornament body will stir up diverse shapes and multiple change in direction to force the ornament the ornament making funny twisting dance along the rotating of the pen barrel.

5 Claims, 4 Drawing Sheets

BALLPOINT PEN STAND DECORATED WITH TWIST DANCING ORNAMENT

BACKGROUND OF THE INVENTION

The prior art of the funny ballpoint pen stand provides the funny effect generally by amusing sound and light. There has also excited another prior art of the funny ballpoint pen stand, whereas under the bottom of the ornament, a linkage of rotary shaft and gear assembly is furnished in much a manner to produce a horizontal and unidirectional rotation (not bidirectional rotation) for the ornament. In this embodiment, the ornament is fixed in place, but the ornament body is permitted to rotate horizontally. The rotation without twisting by the ornament lacks diversity, the least funny effect is attained. In addition, the gear assembly is forced to produce rotation for the ornament by button pressing. This method requires complicated mechanical linkage, rendering hardness to assemble it with expensive production cost, considered not economical gain to produce it as a consumer goods or free gift in the market.

SUMMARY OF THE INVENTION

A ballpoint pen stand decorated with twist dancing ornament according to this invention comprises an ornament, an ornament seat beneath the ornament, a metal wire embedded inside the ornament, a wire fastener under the ornament seat, a pen barrel placed at the bottom of the wire fastener, an ink cartridge contained in the pen barrel and a pen cap for holding the pen barrel. When in complete assembly, the writer holds the ornament seat firmly with one hand, and turns the pen barrel lightly with other hand, as a result causing the wire fastener and the metal wire to rotate. At this moment, even though the ornament itself is motionless, however, the bent metal wire embedded in the ornament body will stir up diverse shapes and multiple change in direction to force the ornament making funny twisting dance along the rotating of the pen barrel.

DETAILED DESCRIPTION OF THE INVENTION

Figure 1:
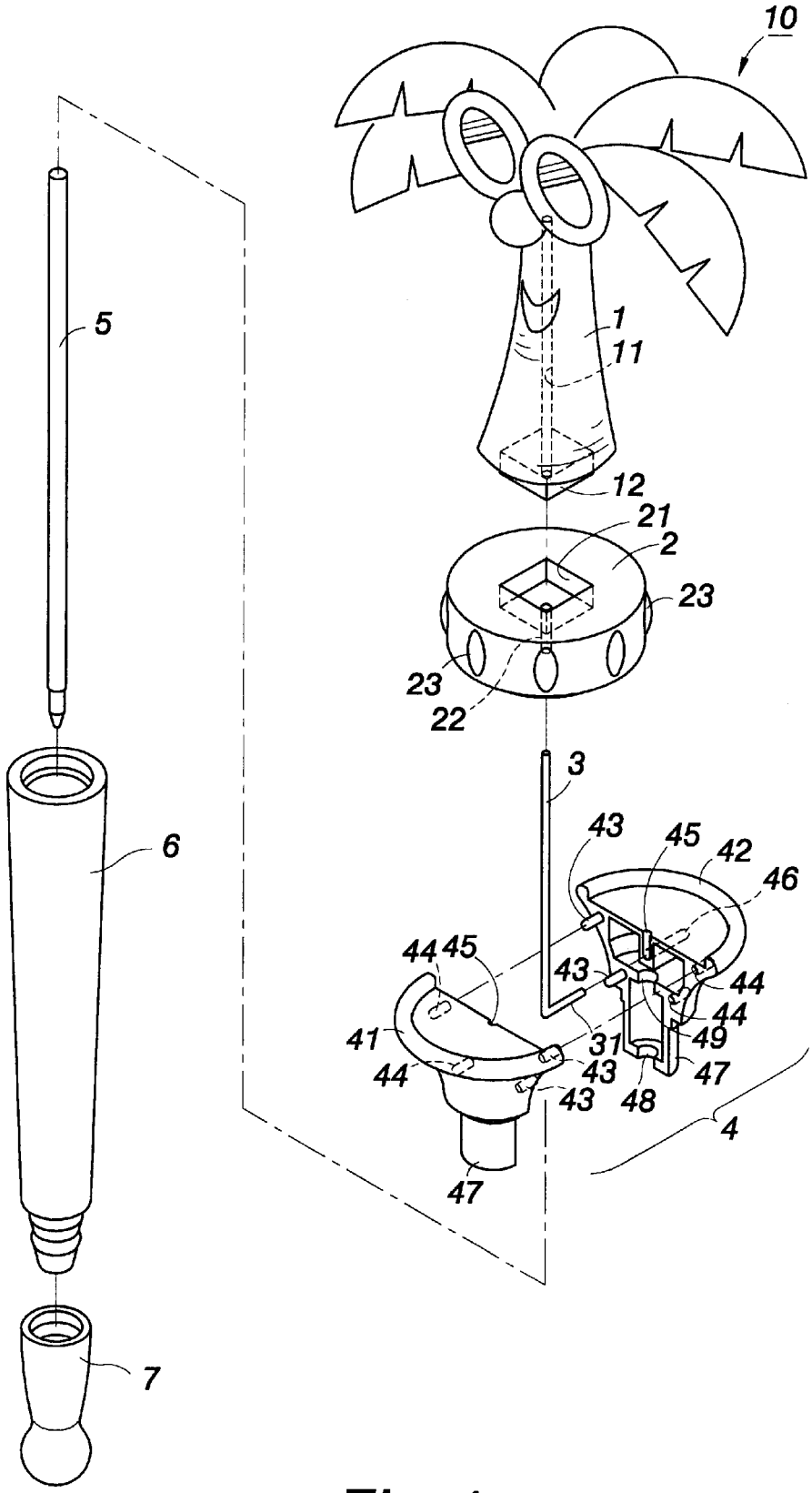
FIG. 1 is the schematic diagram showing the stereo disassembly of the ballpoint pen stand of the invention.
Figure 2:
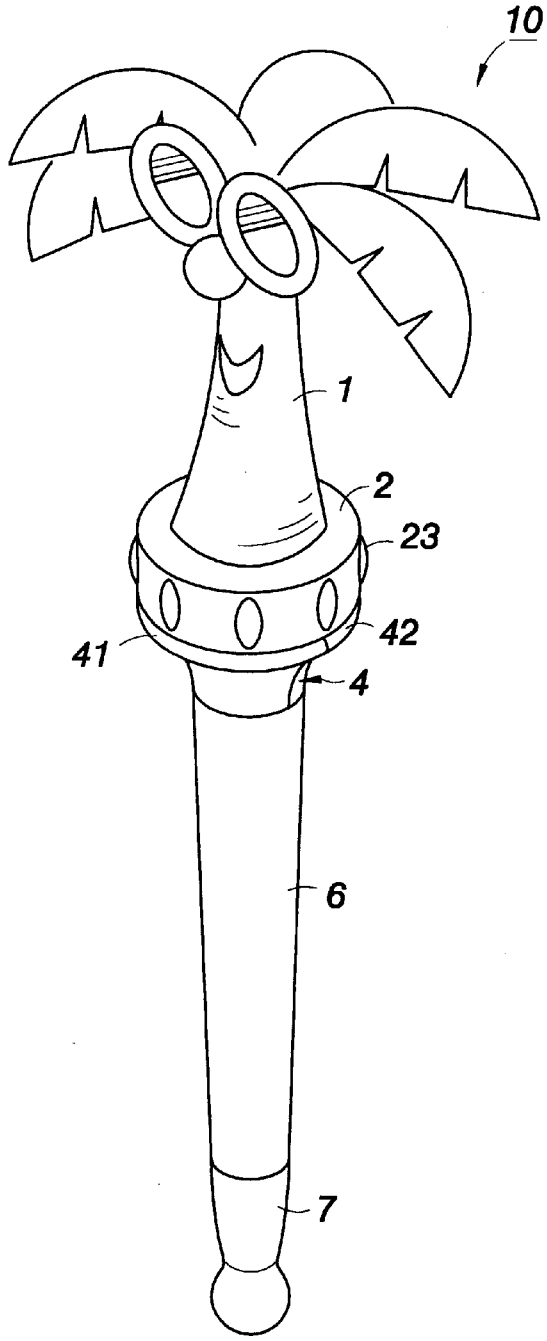
FIG. 2 is the schematic diagram showing the complete stereo assembly of the ballpoint pen stand of the invention.

The invention will be explained in greater detail with the aid of the embodiment as shown in the drawings FIG. 1 is the schematic diagram of the stereo disassembly of the ball point pen stand according to this invention, in which the funny ballpoint pen stand 10 is composed of an ornament 1, an ornament seat 2, a metal wire 3, a metal wire fastener 4, an ink cartridge 5, a pen barrel 6 and a pen cap 7. The complete assembly is shown in FIG. 2.

Figure 3:
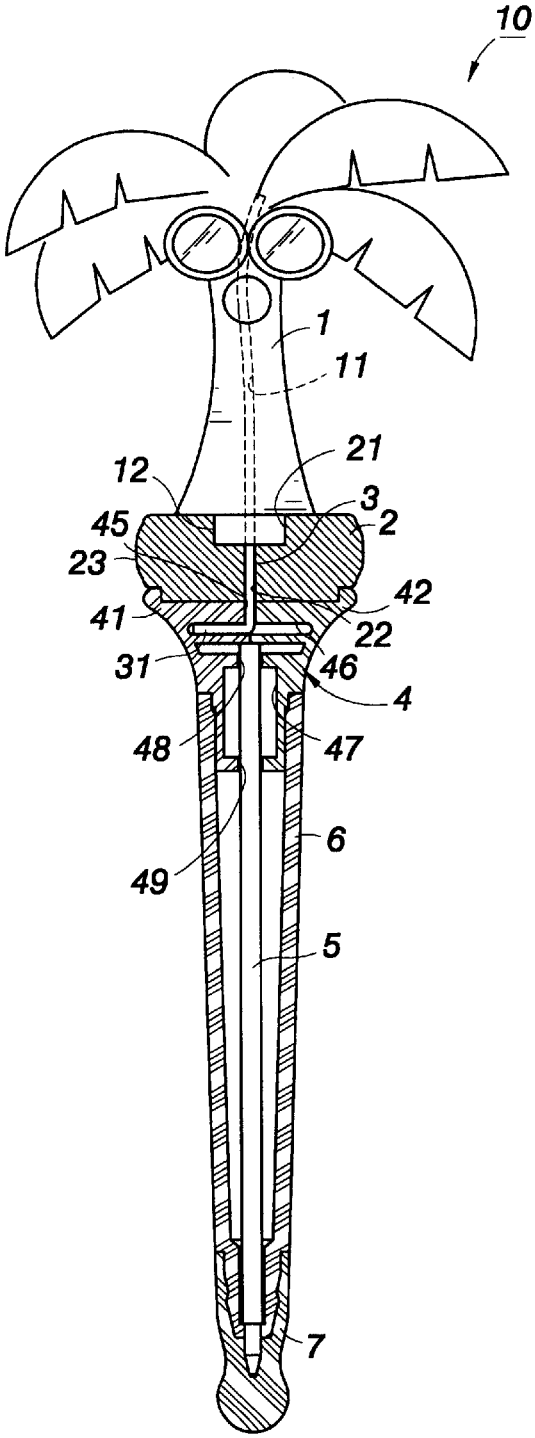
FIG. 3 is the section of the ballpoint pen stand of the invention.

Please refer to FIGS. 1 and 3. FIG. 3 is the section of the ballpoint pen stand of the invention. It illustrates the relative position and embodiment of the ballpoint pen stand with detail description below:

In which the ornament is made from plastic or foam rubber material. In the center, there is a longitudinal tunnel 11 for housing the metal wire 3. The metal wire 3 enters upward from the lower end of the tunnel 11. The ornament 1 has a projected block 12 at the bottom. Preferably the projected block 12 is not in round shape.

On the surface of the ornament seat 2 has a recess 21 to receive the project block 12. The recess 21 provides a go-through hole 22 in the center for the metal wire 3 to pass through. Around the circumference of the ornament seat 2, there scatters raised grain 23 to provide enough abrasive resistance for the writer to turn the ornament seat 2 with no slip.

The metal wire 3 first passes the small hole 22 on the ornament seat 2 and then enters the longitudinal tunnel 11 of the ornament 1. The lower end of the metal wire 3 will be bent into L-shape at the bending point 31. The wire fastener 4 is constitutes of two half torsos 41 and 42 in similar shape, and size. The half torso 41 has at least two lock bolts 43 inside the shell corresponding to two lock cavities 44 on the other half torso 44. When the lock bolts are inserted into the lock cavities, two half torsos are assembled to be become a integrated wire fastener 4. The center of the wire fastener 4 forms an aperture 45, and a L-shape channel 46. The aperture 45 and the L-shape 46 force the metal wire being bent at the L-shape bent-point 31. A locating tube 47 is provided in the wire seat 4 with two go-through holes 48 and 49 at both ends. One end of the ink cartridge 5 will enter the hole 48 and touch the hole 49 so as to be secured in the locating tube 47 to restrict the ink cartridge 5 from quivering. The outer diameter of the locating tube 47 is smaller than the wire fastener, so it can slide into the pen barrel 6. The pen barrel 6 works as a circlip to hold two half torsos 41 and 42 firmly together. The pen cap 7 is connected to the end of pen barrels with a purpose to protect the pen tip 51.

Figure 4:
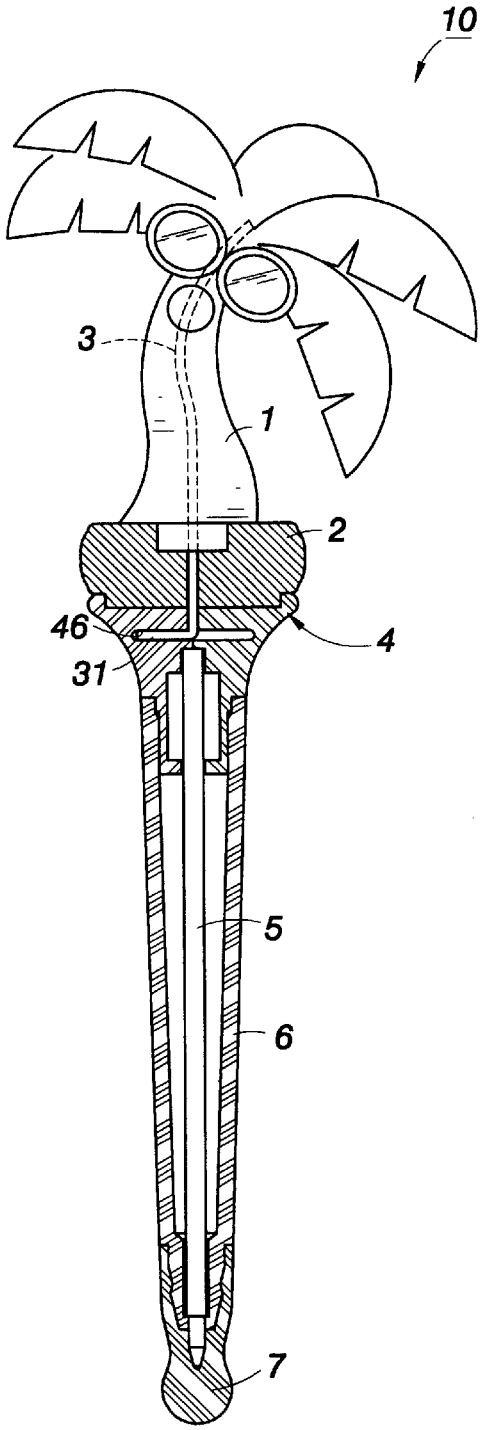
FIG. 4 is the schematic diagram showing a variety of form change of ornament for the ballpoint pen stand of the invention.

FIG. 4 is a schematic diagram showing a changed form of the funny ballpoint pen stand of the invention. As shown, a soft ornament 1 is mounted to the top of the ballpoint pen stand and the metal wire 3 has high plasticity. While the metal wire is bent in different manner, the ornament will perform a variety of actions, such standing up, side bending, bowing, looking up, and hip up (not shown.)

Figure 5:
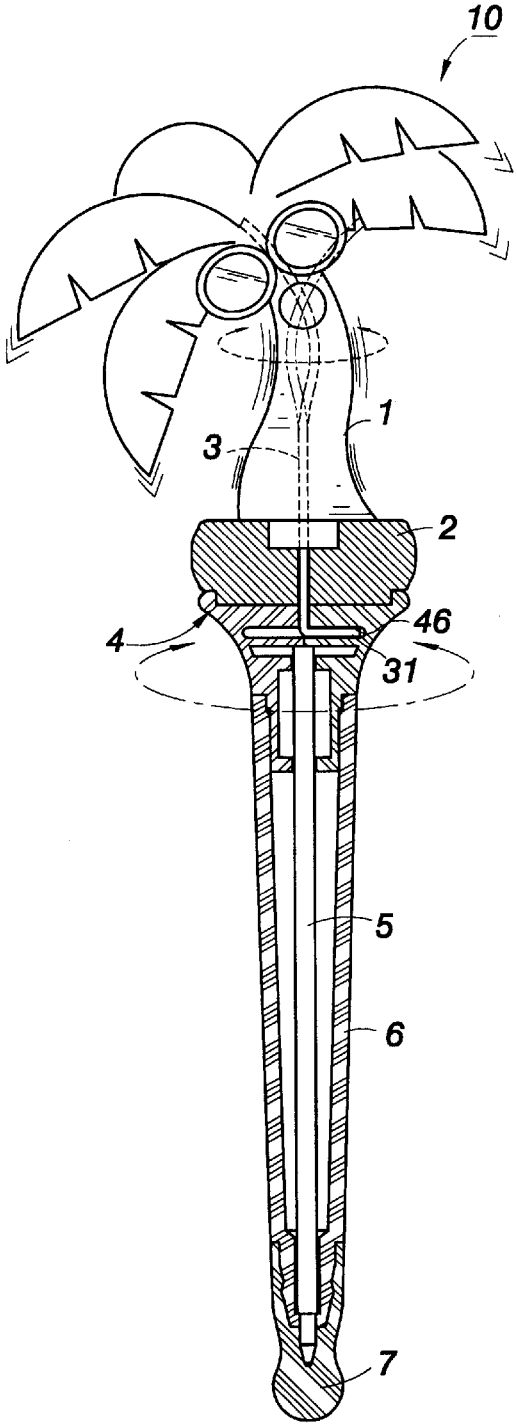
FIG. 5 is the schematic diagram showing a manner of twist dance the ornament is performing on the ballpoint pen stand of the invention.

FIG. 5 show the twist dance the ornament is performing. As shown, when the writer grasps the ornament seat 2 with one hand, and turns the pen barrel 6 with other hand. The bottom of the ornament 1, linked with the ornament seat 2, remains motionless. However the bent metal wire 3 contained inside of ornament 1 will be turned. The ornament 1, responding to curves stirred by the metal wire 3 generates, will create angular deformation, just like making a twist dance to attain the entertainment vision.

By the interaction, when turning the pen barrel, the ornament 1 on the ballpoint pen stand will be stirred to twist or to vibrate, adding up with crow pattern of the ornament will enhance the brilliant laughable fun. Depending on the individual preference, the writer is in the position to adjust the vibration magnitude and poses. The ornament pattern shall not be confined to the palm leaves as shown in the figures. The mermaid, the Hawaii hula-hula girl, the flamingo and the monkey, any pattern can be uses as long as the writer can think of. The terminal end of metal wire 3 is not limited to the L-shape form. It can be in the form of corrugated wave, the J-type or something else. I is also unnecessary for the metal wire to pass the aperture or the L-shape channel. It permits to directly clamp or attach to the ornament seat. The different patterns, poses and angles of the ornament 1 significantly diversify the torso actions, such as shaking head, twisting hip, waving hand, bowing, kicking ball, etc. In short the more diverse bending curve designed for on the metal wire, the more funny action the ornament will carry out. These design changes are included in the scope of this invention.

The practice of the invention will achieve the following outcomes:

1. Simplified construction, easy to assemble. Concurrently for writing.
2. The ornament provides changeable patterns, and the metal wire provides high plasticity. It renders fantastic appearance changes and interesting decoration.
3. The different patterns of the ornament and appropriate bending of the metal wire will produce a wide variety of twist poses.
4. The interaction and design change occurred between the ballpoint pen stand and the ornament will excite the children with greater imagine and interest to learn and to explore the physical characters of the toy when they are playing it.

What is claimed is:

1. A ballpoint pen decorated with a twist dancing ornament comprises:

an ornament made of a soft or plastic material;

an ornament seat fixed beneath the ornament;

a metal wire passing through the ornament seat and entering into the ornament;

a wire fastener for fastening to a terminal end of the metal wire;

a pen barrel having a long tube adapted to be held by a user, wherein the top end of the tube attached to the lower end of the wire fastener;

an ink cartridge, disposed within the pen barrel, having an upper end in engagement with the wire fastener;

a pen cap attached the lower end of the pen barrel for protecting a ballpoint pen tip thereon;

Wherein a complete assembly enables the user to grasp the ornament seat with one hand and rotate the pen barrel with the other hand; as a consequence, the wire fastener and the metal wire are forced to rotate while the ornament, fixed onto the ornament seat; remains motionless; the metal wire inside of the ornament begins to change directional angle and create a twist dancing movement so that a quivering funny effect for the ornament is achieved.

2. The ballpoint pen decorated with a twist dancing ornament as claimed in claim 1, in which the ornament provides a central longitudinal tunnel for housing the metal wire.

3. The ballpoint pen decorated with a twist dancing ornament as claimed in claim 1, in which the ornament has a projected block at its bottom, and the top surface of the ornament seat has a recess with a go-through hole allowing the metal wire to pass through.

4. The ballpoint pen decorated with a twist dancing ornament as claimed in claim 1, in which the wire fastener has a hollow locating tube with two go-through holes at its both ends for the ink cartridge to pass the lower end hole, extend to the upper hole, and enter into an attached position.

5. The ballpoint pen decorated with a twist dancing ornament as claimed in claim 1, in which the wire fastener is composed of two half torsos in identical shape and size; wherein one half torso has two bolts along the inner wall and the other half torso has two cavities along its inner wall such that when the bolts are inserted into the cavities, two torsos integrally form the fastener.

* * * * *